US007284736B2

(12) United States Patent
Franssen

(10) Patent No.: US 7,284,736 B2
(45) Date of Patent: Oct. 23, 2007

(54) MOUNTING BRACKET

(75) Inventor: Johannes Robertus Maria Franssen, Breda (NL)

(73) Assignee: Hunter Douglas Industries BV, El Rotterdam (NL)

( * ) Notice: Subject to any disclaimer, the term of this patent is extended or adjusted under 35 U.S.C. 154(b) by 22 days.

(21) Appl. No.: 11/194,256

(22) Filed: Aug. 1, 2005

(65) Prior Publication Data

US 2006/0021718 A1 Feb. 2, 2006

(30) Foreign Application Priority Data

Aug. 2, 2004 (EP) ..... 04077208

(51) Int. Cl.
*A47H 1/14* (2006.01)

(52) U.S. Cl. ..... 248/251; 248/223.41; 248/220.21; 160/178.1 R; 160/178.1 V; 160/902; 52/712

(58) Field of Classification Search ..... 248/223.41, 248/220.21, 251; 160/178.1 R, 178.1 V, 160/902; 52/712
See application file for complete search history.

(56) References Cited

U.S. PATENT DOCUMENTS 4,411,401 A * 10/1983 Anderson ..... 248/262
4,475,706 A * 10/1984 Anderson ..... 248/542
4,938,443 A * 7/1990 Rowe ..... 248/251
5,180,130 A * 1/1993 McMichael ..... 248/251
5,186,426 A * 2/1993 Wada ..... 248/251
5,195,570 A * 3/1993 Marocco ..... 160/178.1 R
5,230,493 A * 7/1993 Luoto ..... 248/251
5,353,857 A * 10/1994 Anderson ..... 160/178.1 R
5,533,560 A * 7/1996 Morris ..... 160/178.1 R
6,315,489 B1 * 11/2001 Watanabe ..... 403/381
6,322,029 B1 * 11/2001 Sonnenberg et al. ... 248/222.13
6,382,296 B1 * 5/2002 Judkins ..... 160/178.1 R
6,550,523 B1 * 4/2003 Chen ..... 160/178.1 R
6,561,254 B1 * 5/2003 Liu ..... 160/177 R
D482,223 S * 11/2003 Bibby et al. ..... D6/580
7,048,028 B2 * 5/2006 Wolfe et al. ..... 160/173 R

* cited by examiner

*Primary Examiner*—Carl D. Friedman
*Assistant Examiner*—Michael McDuffie
(74) *Attorney, Agent, or Firm*—Dorsey & Whitney LLP

(57) ABSTRACT

A one-piece bracket for mounting the headrail of a covering for an architectural opening comprises a generally L-shaped piece having a system for retaining the headrail on the bracket and restricting movement of the headrail on the bracket.

6 Claims, 2 Drawing Sheets

MOUNTING BRACKET

CROSS-REFERENCE TO RELATED APPLICATION

This application claims priority to European patent application No. 04077208.9, filed 2 Aug. 2004, which is hereby incorporated by reference as fully disclosed herein.

BACKGROUND OF THE INVENTION

1. Field of the Invention

This invention relates to a mounting bracket for a head rail of a covering for an architectural opening. The invention particularly relates to a single piece mounting bracket that is hardly visible from the front of the covering and allows for easy mounting and dismounting of the head rail.

2. Description of the Related Art

Numerous mounting brackets are known for head rails of architectural coverings. Typical mounting brackets are shown, for example, in U.S. Pat. No. 5,353,857, U.S. Pat. No. 5,533,560 and U.S. Pat. No. 5,180,130. Each of these brackets is suitable for mounting a head rail that is generally U-shaped rail and has longitudinally extending front, rear and bottom walls.

One of such headrails is described in U.S. Pat. No. 5,353,857. In this headrail the top edge of the front wall 24 of the head rail 20 is provided with a longitudinal front headrail lip 25 that extends horizontally and inwardly from the front wall towards the rear wall 21; the top edge 23 of the rear wall 21 of the head rail has a similar longitudinal rear headrail lip 22 that extends horizontally and inwardly from the rear wall 21 towards the front wall 24. Additionally the rear wall of the bracket is provided with a longitudinal mounting rim 26 that extends horizontally and rearwardly from the rear wall.

The headrails of the other prior art publications are generally the same. Each of these headrail is suitable for being mounted in the bracket of the invention.

The prior art bracket from U.S. Pat. No. 5,353,857 is a generally L-shaped bracket and comprises a top plate 41 and a rear plate 42. The top plate has a ramp portion 43 extending downwardly and at an angle away from front edge 44. A front bracket lip 46 for engaging the lower surface of the front headrail lip 25 extends horizontally and outwardly from the front edge 45 of the ramp portion 43. A spring arm 47 extends downwardly from the front edge 44 of the top plate 41 and towards the rear plate 42 for engaging by its end portion or restraining lip 48 the top of the rear head rail lip 22. A bottom ledge 49 extends horizontally outwardly from the rear plate 42, from the ledge a hook barb 51 extends upwardly for engaging the mounting rim 26 of the head rail.

The headrail is mounted to the bracket by urging the headrail up at an angle toward the corner 53 formed by the intersection of the rear plate 42 and the top plate 41. This forces the rear headrail lip 22 up into contact with the restraining lip 48 of the spring arm, and also allows the hook shaped mounting rim 26 to pass over the hooked restraining barb 51. Upon release the recoil of the spring arm 47 forces the rear headrail lip 22 and the rear wall 21 down, thereby allowing the hook rail 26 to engage the restraining barb 51. The hook barb 51 in combination with the hooked mounting rim 26 prevents any movement from the head rail horizontally either toward or away from the rear plate 42. In a different embodiment in FIG. 10 the hook feature is moved by having a hooked front head rail lip 29, 30 in combination with a hooked front bracket lip 51c. The bottom ledge 49 extends horizontally without hooked barb.

A drawback of this prior art bracket is that general large vertical displacement is needed to mount and dismount the bracket, because the hooked barb and/or hooked front bracket lip has to be cleared before the headrail is mounted or can actually be moved free of the bracket. This requires a delicate manoeuvring and for large blinds with a number of brackets spaced along the headrail a considerable and carefully co-coordinated force is needed. The other prior art bracket as described in U.S. Pat. No. 5,180,130 and U.S. Pat. No. 5,530,560 have the same drawbacks caused by hook-shaped engagement members, even though these brackets are different in some other details.

It is therefore an object of the invention to provide a bracket with the same general characteristics as the bracket of U.S. Pat. No. 5,353,857 but to which a headrail can be more easily mounted.

SUMMARY OF THE INVENTION

It is also an object of the invention to provide a bracket without the hooked restraining barb and/or hooked front bracket lip that have to be cleared, but including an alternative restraint means against any movement from the head rail horizontally either toward or away from the rear plate 42.

It is also an object of the invention to provide a bracket from which the headrail can be more easily dismounted.

Tolerances in the production process of head rails can result in a head rail of which the height of the front and rear walls are more or less than the bracket was designed for. This could than result in a headrail that fits too tight or too loose. It is therefore also an object of the invention to provide a bracket that allows for such a height tolerance of the headrail in relation to bracket.

According to the invention there is provided a generally L-shaped, single piece mounting bracket for mounting a headrail of an architectural covering to a fixed surface such as a wall or a ceiling, said bracket comprising a horizontal top body portion; a vertical rear body portion extending perpendicular from a longitudinal rear edge of the top body portion; support means at the rear body portion for restricting said headrail from downward movement when mounted to the bracket; at least one spring arm at the top body portion for urging said headrail, when mounted to the bracket, into engagement with the support means; at least one restraining flange for restricting movement of said headrail, when mounted to the bracket, horizontally toward or away from said rear body portion; characterized in that the at least one restraining flange is integrally formed at the at least one spring arm at the top body portion of the bracket.

According to another aspect of the invention the top bracket portion of the bracket of the invention comprises a front edge and a pair of lateral left and right side edges, and wherein the at least one spring arm extends generally rearwardly and downwardly from one of the lateral side edges adjacent the front edge toward the rear body portion According to another aspect of the invention the at least one spring arm of the bracket of the invention comprises an outer and an inner lateral side edge and the at least one restraining flange depends from either the lateral outer side edge or the lateral inner side edge.

According to yet another aspect of the invention the restraining flange of the bracket of the invention comprises a vertical rear edge adjacent the rear bracket portion, a horizontal bottom edge extending below and parallel to the lateral side edge of the spring arm from which the restraining flange depends, and an forwardly and upwardly sloping front edge extending towards the lateral side edge of the spring arm from which the restraining flange depends.

According to yet, yet, yet another aspect of the invention the support means of the bracket of the invention is a resilient spring leg comprising a support member for headrail.

BRIEF DESCRIPTION OF THE DRAWINGS

Further aspects of the invention will be apparent from the detailed description below of particular embodiments and the drawings thereof in which.

DETAILED DESCRIPTION OF THE PREFERRED EMBODIMENTS

Figure 1:
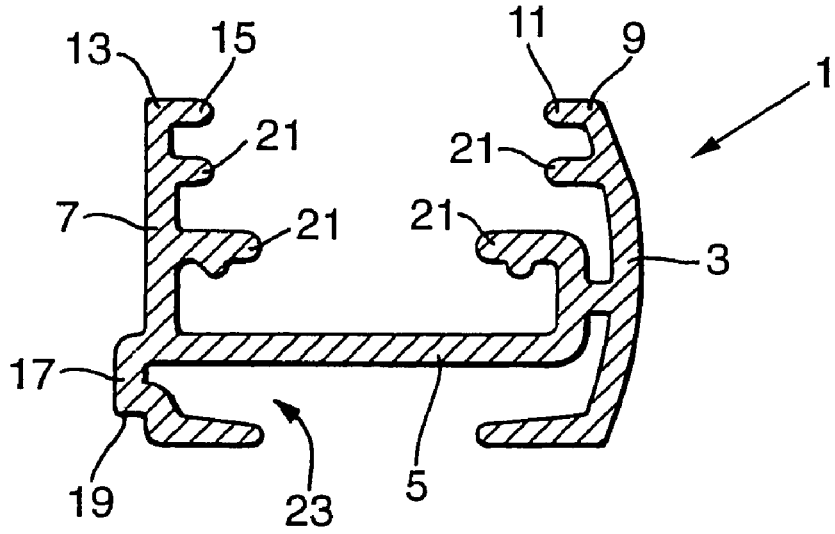
FIG. 1 is a cross-sectional view of a headrail suitable to be mounted to the bracket of the invention.

In FIG. 1 a headrail 1 is shown in cross-section as it is mounted to the bracket 31. The bracket is best visible in all three FIGS. 2-4.

The headrail 1 is a generally elongated U-shaped profile, with an elongated front wall 3, an elongated bottom wall 5 and an elongated rear wall 7. The top edge 9 of the front wall 3 is provided with a front wall lip 11 that extends horizontally and rearwardly from the front wall towards the rear wall 7. Likewise the top edge 13 of rear wall 7 is provided with a rear wall lip 15 that extends horizontally and rearwardly from the rear wall towards the front wall 3. Additionally the rear wall 7 is provided with a mounting bead or rim 17 that extends generally horizontally and rearwardly away from the rear wall 7 and having at least a horizontal bottom portion 19 for engagement to the bracket. The interior cross-section of the headrail as shown in FIG. 1 is provided with a number of rims or flanges 21 that do not relate to the invention but are typical for a headrail that is suitable for mounting a pleated blind. These rims 21 do not relate to the bracket and are therefore not further described. Also the headrail shown in FIG. 1 is provided with a downwardly open bottom channel 23, which is also not related to the invention and not further explained but is typical for a headrail that is suitable for mounting a pleated blind.

Figure 4:
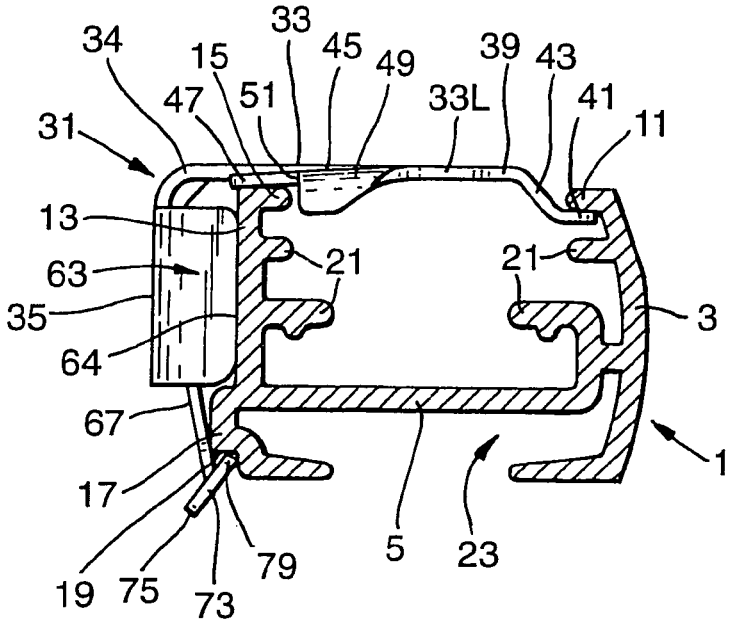
FIG. 4 is an end view the bracket of invention to which the headrail of FIG. 1 is mounted, the headrail is shown in cross-section.

The headrail as shown in FIGS. 1 and 4 is only an example of a headrail that can be mounted to the bracket of the invention. Almost any type of U-shaped channel-like headrail can be mounted in the bracket of the invention as long as it is provided with a front and rear headrail lip and a mounting rim.

The bracket 31 is a single piece, generally L-shaped bracket having a top plate 33 and a rear plate 35 at generally right angle to each other, in that the rear plate 35 extends perpendicular from rear body edge 34 of the top plate 33. The top plate 33 is preferably general rectangular in shape and further includes left and right outer lateral side edges 33L and 33R.

The top plate 33 has a ramp portion 37 extending downwardly and at an angle away from front edge 39. A front bracket lip 41 for engaging the lower surface of the front headrail lip 11 extends horizontally and outwardly from the front edge 43 of the ramp portion 37. The ramp portion 37 and front bracket lip 41 ensure that once a headrail is mounted to the bracket there are no engagement parts of the bracket to the front wall of the headrail that are visible. A pair of left and right spring arms 45, 45' extend downwardly from either lateral side edges 33L, 33R of the top plate 33 near the front edge 43 thereof and towards the rear plate 35 for engaging, by its end portion 47, 47', the top of the rear headrail lip 15. The spring arms 45, 45' each include generally parallel opposite lateral outer and inner side edges 87, 87', 89, 89'. The lateral outer side edge 87,87' is co-extending with respectively the left and right lateral side edges 33L, 33R of the top plate 33. In this respect the bracket is identical to the bracket of U.S. Pat. No. 5,353,857.

In accordance with the invention the left and right spring arms 45, 45' each are provided with a downwardly extending spring arm flanges 49, 49'. The spring arm flanges 49,49' extend from the outer lateral side edges 87,87' of the spring arms 45,45'. The spring arm flanges each have a vertical downwardly extending rear edge 51, 51', a horizontal forwardly extending bottom edge 53, 53', an upwardly and forwardly sloped front edge 55,55' and a horizontal top edge 57, 57'. The horizontal top edge 57, 57' co-extends with the lateral outer side edge 87,87' of the spring arm 45,45'. The sloped front edge 55, 55' runs from the front corner 59, 59' of the bottom edge 53,53' of the spring arm flange towards the front corner 61, 61' of the top edge 57,57'. The function of the spring arm flange is explained below in relation to FIG. 4 where a headrail is mounted to the bracket.

Figure 3:
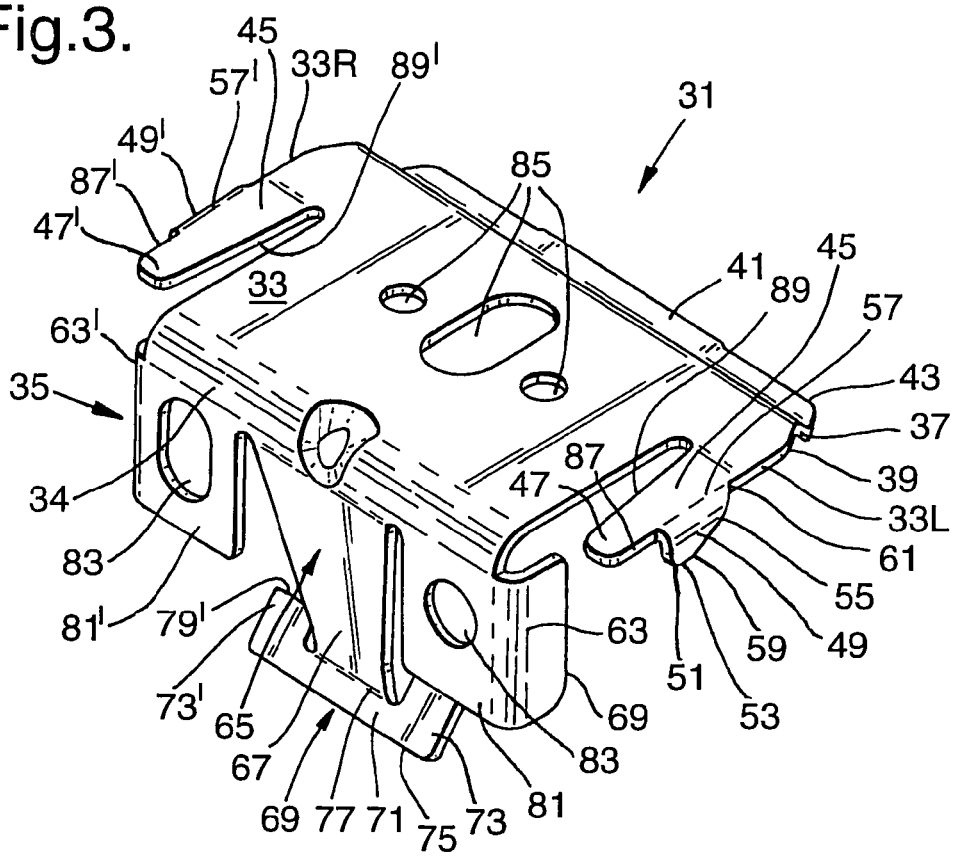
FIG. 3 is a schematic perspective rear of the front of the bracket of the invention.

As can be best seen from FIG. 3, the rear plate 35 of the bracket is provided with a pair of left and right forwardly extending side flanges 63, 63', which limit movement of the rear wall 7 of the headrail during installation. They also ensure that the rear headrail lip 15 comes into engagement with the left and right spring arm end portions 47,47' when the headrail is mounted to the bracket.

Conventional resilient support means are provided on the rear plate 35 of the bracket for engaging the bottom portion 19 of the mounting rim 17 of the headrail to support the headrail and restrict downward movement of the headrail. Such a support means as best visible in FIGS. 3 and 4 is preferably a spring leg 65 extending from the rear plate 35. The spring leg 65 extends generally downwardly at a forward angle and is biased in forward direction. The spring leg 65 comprise a leg portion 67 and a support member 69. Preferably the spring leg 65 is position generally in the middle of the rear plate 35. The support member 69 is a generally C-shaped member having a base 71 and a pair of left and right ears 73, 73'. The base 71 is generally rectangular and includes an outer edge 75 and a parallel opposite inner edge 77. The support member 69 is attached to the back of the spring leg portion 67 by its inner edge 77 and its base 71 extends rearwardly and downwardly at angle of bottom section of the leg portion 67. The ear portions 73, 73' extend from inner edge 77 of the base 71 and on either side of the spring leg 67. The ears 73, 73' also extend at an angle but forward and upwardly relative to the leg portion 69 of the spring leg 65. The front rims 79, 79' of the left and right ears 73, 73' will engage the bottom portion 19 of the mounting rim 17 of the headrail upon assembly of the headrail to the bracket.

The rear plate 35 is divided into left and right rear wall mounting portions 81, 81', each provided with openings 83, 83' suitable for receiving fastening means for fixing the bracket to a wall.

In this respect the pair of left and right forwardly extending side flanges 63, 63' each extend from the respectively left and right outer lateral side of the respectively left and right wall mounting portions 81, 81'.

The top plate 33 of the bracket is provided with openings 85 suitable for receiving fastening means for fixing the bracket to a ceiling.

After the bracket has been secured to a fixed surface such as a wall or a ceiling, the headrail can now be easily mounted to the bracket, as their are no hooked parts that have to be cleared. The headrail is mounted to the bracket by placing the front headrail lip 11 over the front bracket lip 41 and subsequently urging the headrail forward and particularly the mounting rim 17 and its bottom part 19 into engagement with the support member 69 of spring leg 65. As this is done the spring arm flange 49 is urged slightly upwards by the rear headrail wall and lip 13, 15 passing the flange. The sloped front edge 55 and the upward flexing of the spring arm flanges 49, 49' both ease the passage of the headrail. At the same time the movement of pushing the headrail and its mounting rim 17 into engagement with the spring leg 65 and its support member 69, the spring leg 65 flexes slightly rearwardly. After the rear headrail lip 15 passed the spring arm flanges 49, 49' the spring leg will recoil back and the spring arm end portion will rest on top of the rear headrail lip 15. At the same time the spring leg support member 69 will engage the bottom part 19 of the mounting rim of the headrail. Upon release of the headrail, which is now in place, the recoil of the spring arms 47,47' forces the rear headrail lip 15 and the rear wall 7 down, thereby more firmly engaging the spring leg support member 69 preventing downward movement from the headrail relative to the bracket. At the same time the rear edge 51, 51' of the spring arm flanges 49, 49' prevent any movement from the head rail horizontally either toward or away from the rear plate 42.

Another advantage of the bracket of the invention becomes clear at dismounting the headrail from the bracket. A screwdriver or similar tool can be used to unlatch the support member 69 from the mounting rim 17. Once unlatched, the downwardly biased spring arms 45, 45' and their end portions 47, 47' will eject the headrail from the bracket by the downward force they exert on the rear headrail lip 15.

Tolerances in the production process of head rails can result in a head rail of which the height of the front and rear walls are more or less than the bracket was designed for. This could than result in a headrail that fits too tight or too loose. The resiliency of the spring leg 65 and the spring arms 45, 45' allow for such a height tolerance of the headrail in relation to bracket.

This invention is, of course, not limited to the specifically described embodiment. This embodiment can be modified without departing from the scope of the invention or sacrificing all of its advantages. In this regard, the terms in the foregoing description and the following claims, such as "rear", "front" "rearwardly", "forwardly", "downwardly", "horizontally", "upper", "lower", "left", "right", "top" and "bottom", have been used only as relative terms to describe the relationships of the various elements of the bracket of the invention as shown in the Figures.

In this respect the spring arm flange 49,49' which acts as a means for restricting any movement of the head rail horizontally relative to the rear plate 42, is shown to depend from the lateral outer side edges 87, 87' of the spring arms 45, 45'. The flanges 49,49' can however also depend from the lateral inner side edges 89, 89' of the spring arm 45,45' and have the same function.

Also the spring arms 45,45' have been depicted as extending on the outer lateral sides 33L,33R of the top plate 33. However, it is feasible that the spring arms depend from the top plate 33 at a location removed from the outer lateral sides.

Figure 2:
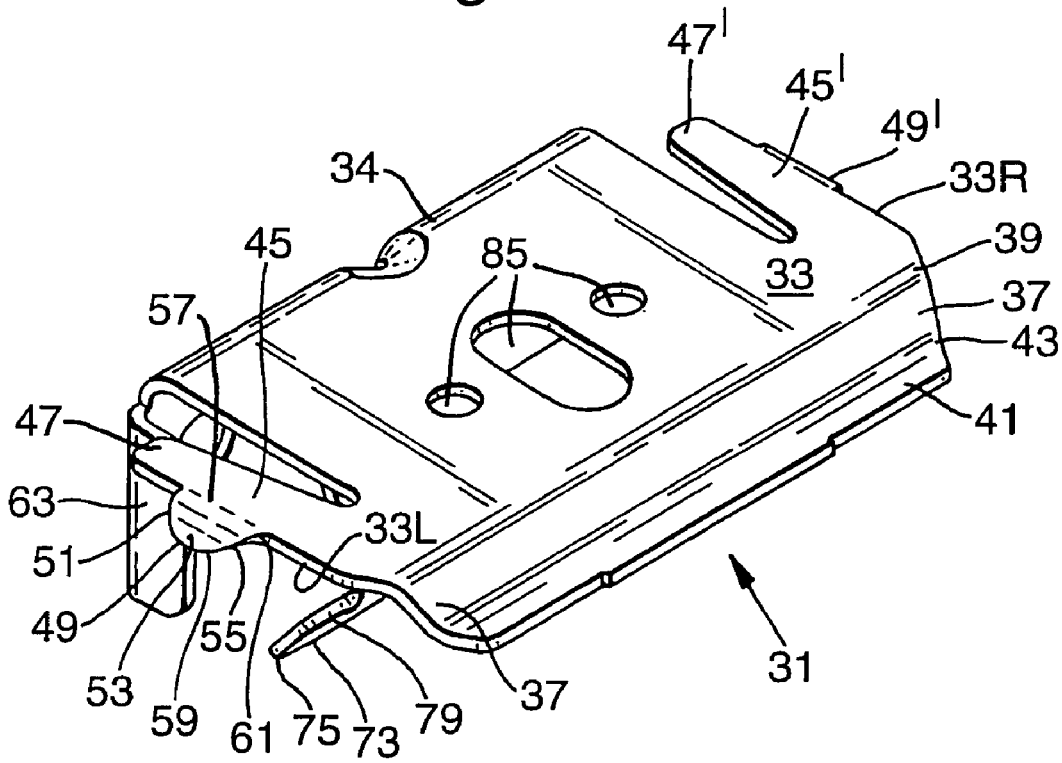
FIG. 2 is a schematic perspective view of the front of the bracket of the invention.

Also, it is clear that in the embodiment of the bracket as shown in FIGS. 2-4, the front edge 64, 64' of the side flanges 63, 63' of the rear plate 35, 35' also helps to limit any movement of the head rail horizontally relative to the rear plate 42. However the side flanges are not necessary for the spring arm flanges 49,49' to limit this type of movement. When no side flanges are available, the spring arm flange may have to be positioned somewhat closer to the rear plate, or they have to be laterally longer. The space remaining between the front edge of the rear headrail lip 15 and the rear edge 51, 51' of the spring arm flanges 49, 49' must be smaller than the overlap of the front headrail lip 11 on the front bracket lip 41.

Also, although not shown in the Figures, in an alternative embodiment the bracket could be provided with only a single spring arm, and a single spring arm flange.

Also the support means, although shown to be a resilient spring leg and a support member, could be a flange extending horizontally and forwardly form the rear bracket plate, such as is shown in e.g. FIG. 10 of U.S. Pat. No. 5,353,857.

I claim:

1. A generally L-shaped, single piece mounting bracket for mounting a headrail of an architectural covering to a fixed surface such as a wall or a ceiling, said bracket comprising:

a horizontal top body portion;

a vertical rear body portion extending perpendicular from a longitudinal rear edge of the top body portion;

support means at the rear body portion for restricting said headrail from downward movement when mounted to the bracket;

at least one spring arm at the top body portion having an end portion for urging said headrail, when mounted to the bracket, into engagement with the support means;

at least one restraining flange for restricting movement of said headrail, when mounted to the bracket, horizontally toward or away from said rear body portion; and characterized in that the at least one restraining flange is integrally formed at the at least one spring arm at the top body portion of the bracket and spaced from said end portion.

2. The bracket of claim 1 wherein the top bracket portion comprises a front edge and a pair of lateral left and right side edges, and wherein the at least one spring arm extends generally rearwardly and downwardly from one of the lateral side edges adjacent the front edge toward the rear body portion.

3. The bracket of claim 2 wherein the at least one spring arm comprises an outer and an inner lateral side edge and the at least one restraining flange depends from either the lateral outer side edge or the lateral inner side edge.

4. The bracket of claim 1 wherein the support means is a resilient spring leg comprising a support member for supporting the headrail.

5. A generally L-shaped, single-piece mounting bracket for mounting a headrail of an architectural covering to a fixed surface, such as a wall or a ceiling, said bracket comprising:

a horizontal top body portion;

a vertical rear body portion extending perpendicular from a longitudinal rear edge of the top body portion;

support means at the rear body portion for restricting said headrail from downward movement when mounted to the bracket;

at least one spring arm at the top body portion for urging said headrail, when mounted to the bracket, into engagement with the support means;

at least one restraining flange for restricting movement of said headrail, when mounted to the bracket, horizontally towards or away from said rear body portion;

characterized in that the at least one restraining flange is integrally formed at the at least one spring arm at the top body portion of the bracket;

wherein the top bracket portion comprises a front edge and a pair of lateral left and right side edges, and wherein the at least one spring arm extends generally rearwardly and downwardly from one of the lateral side edges adjacent the front edge toward the rear body portion; and wherein the at least one spring arm comprises an outer and inner lateral side edge and the at least one restraining flange depends from either the lateral outer side edge or the lateral inner side edge.

6. The bracket of claim 5 wherein the restraining flange comprises a vertical rear edge adjacent the rear bracket portion, a horizontal bottom edge extending below and parallel to the lateral side edge of the spring arm from which the restraining flange depends, and an forwardly and upwardly sloping front edge extending towards the lateral side edge of the spring arm from which the restraining flange depends.

* * * * *

UNITED STATES PATENT AND TRADEMARK OFFICE

CERTIFICATE OF CORRECTION

PATENT NO. : 7,284,736 B2
APPLICATION NO. : 11/194256
DATED : October 23, 2007
INVENTOR(S) : Johannes Robertus Maria Franssen It is certified that error appears in the above-identified patent and that said Letters Patent is hereby corrected as shown below:

Col. 6, lines 57-60;
Delete Claim 3 in its entirety.

Signed and Sealed this

Eighteenth Day of March, 2008

JON W. DUDAS
*Director of the United States Patent and Trademark Office*